US005082324A

United States Patent [19]

Harada et al.

[11] Patent Number: 5,082,324

[45] Date of Patent: Jan. 21, 1992

[54] FOLDABLE RECLINING CHAIR

[75] Inventors: Hidenari Harada, Fukuoka; Kensaku Fukaya, Tokyo, both of Japan

[73] Assignee: Ben Company Ltd., Fukuoka, Japan

[21] Appl. No.: 685,913

[22] Filed: Apr. 16, 1991

[51] Int. Cl.[5] ..... A47C 1/02

[52] U.S. Cl. ..... 297/83; 297/68; 297/433

[58] Field of Search ..... 297/84, 83, 433, 436, 297/68, 320

[56] References Cited

U.S. PATENT DOCUMENTS 3,228,725 1/1966 Rowe ..... 297/84

FOREIGN PATENT DOCUMENTS 479408 12/1951 Canada ..... 298/84
865950 12/1952 Fed. Rep. of Germany ..... 297/84
0000428 1/1983 Japan ..... 297/84
154185 6/1988 Japan .

*Primary Examiner*—Kenneth J. Dorner
*Assistant Examiner*—Cassandra Hope
*Attorney, Agent, or Firm*—Fleit, Jacobson, Cohn, Price, Holman & Stern

[57] ABSTRACT

A reclining chair is arranged having a back rest pivotably supported and mounted at its intermediate region to the upper lower and right arm portions of a base frame, a seat pivotably mounted at its rear end to the lowermost section of the back rest at a point situated lower than the intermediate back rest pivot, a foot rest pivotably mounted to and supporting the front end of the seat, and an extending member extending from the foot rest to a point lower than the pivot joint between the back rest and the seat for pivotal movement. The foot rest is sustained in sleeve-rod arrangement on the base frame.

2 Claims, 4 Drawing Sheets

FOLDABLE RECLINING CHAIR

BACKGROUND OF THE INVENTION

1. Field of the Invention

The present invention relates to a foldable reclining chair.

2. Description of the Prior Art

A preceding reclining chair has been invented by the same applicant as disclosed in Japanese Patent Laid-open Publication 63-154185 (1988).

The prior art reclining chair is made of a considerable number of components, which increases the cost of production.

SUMMARY OF THE INVENTION

It is an object of the present invention to provide a reclining chair which is less expensive to manufacture.

The reclining chair according to the present invention comprises a base frame which has right and left arm portions and is placeable on a floor, a back rest pivotably mounted at a point intermediate to the rear right and left arm portions of the base frame, a seat pivotably mounted to and supported by the lowermost portion of the back rest at a point beneath the pivot joint to the base frame, a foot rest pivotably mounted to the front end of the seat so that it can move between a vertical position and a level position to the seat, an extending member pivotably mounted at one end to the back of the foot rest, tubular members slidably fitted on the extending member and also, fixedly a support plate positioned between the lower sections of the left and right arm portions mounted to the front of the base frame, and a connecting member pivotably mounted at one end to the foot rest and at the other end to a an extension of the back rest which is lower than the pivot joint between the seat and the back rest.

The reclining chair of the present invention is arranged, like applicant's preceding reclining chair, in which both the back rest and the seat can move forward and backward as the back rest is tilted up and down. Accordingly, the user's center of gravity remains unshifter relative to the front or back of the chair regardless of whether the user is sitting up or lying down. As a result, the chair is stable in use and its back rest will smoothly tilted without an urging force.

DETAILED DESCRIPTION OF THE PREFERRED EMBODIMENT

Figure 1:
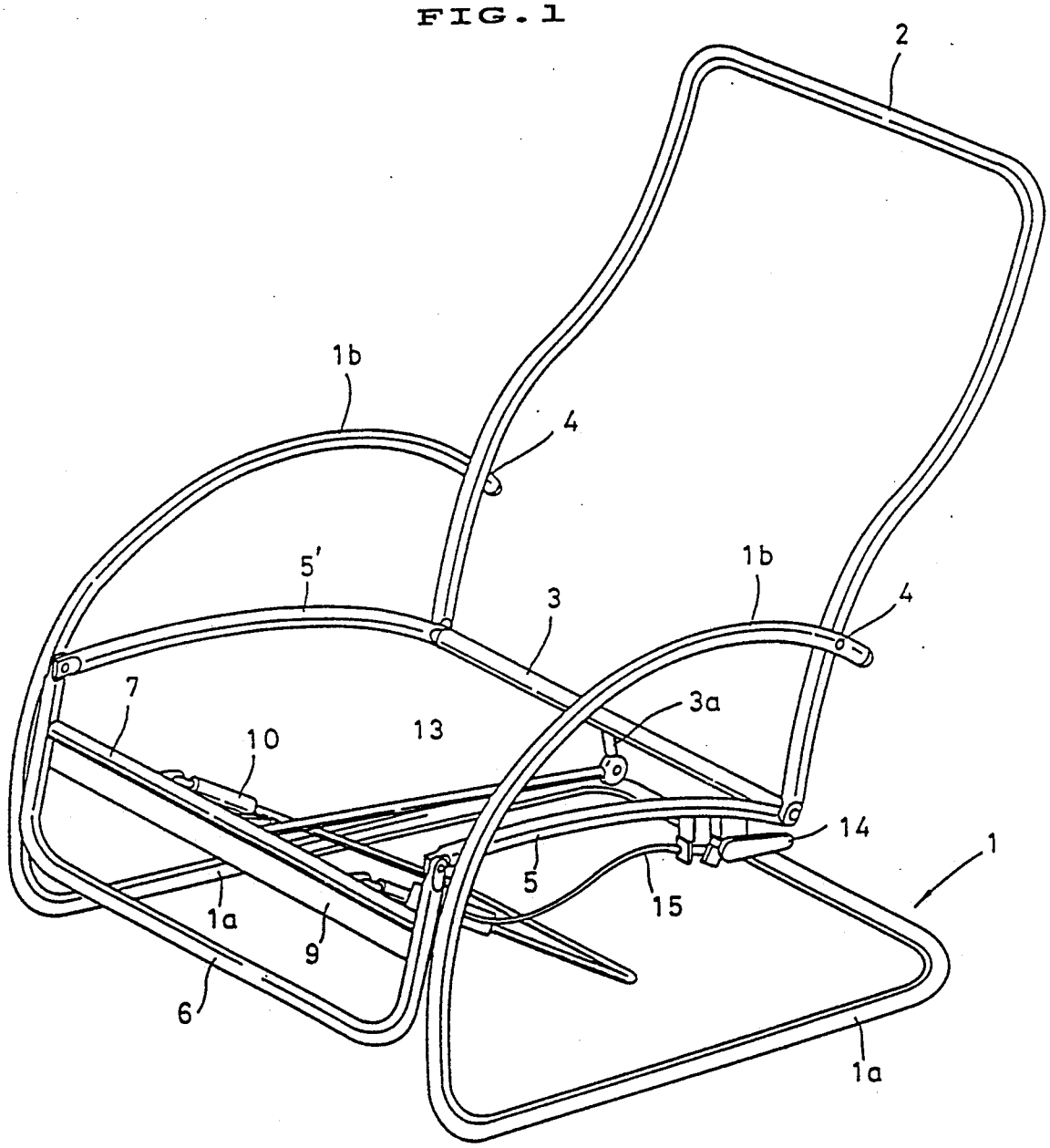
FIG. 1 is a perspective view of a reclining chair according to the present invention.
Figure 2:
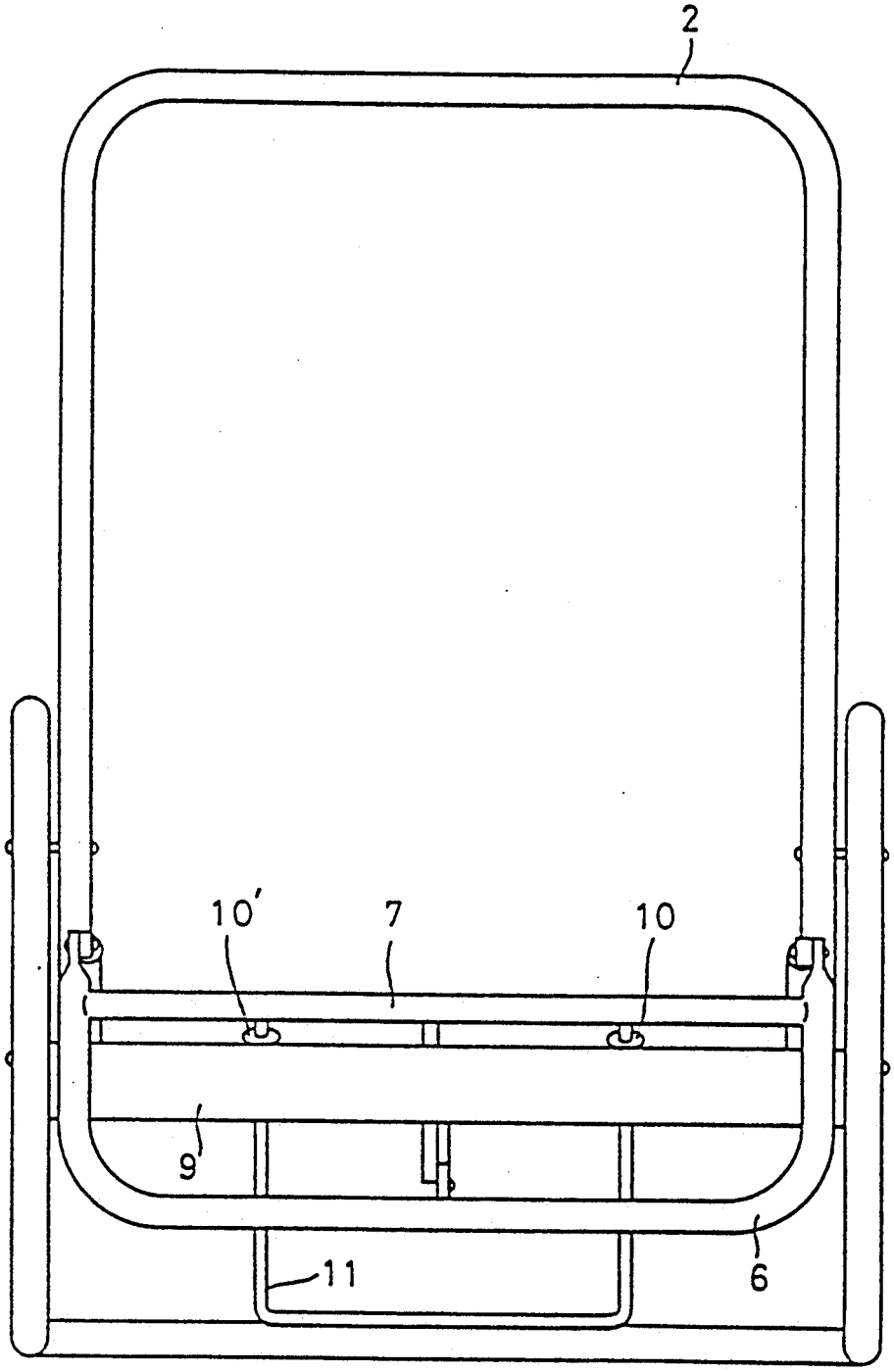
FIGS. 2, 3, and 4 are front, plan, and side views of the same, respectively.
Figure 3:
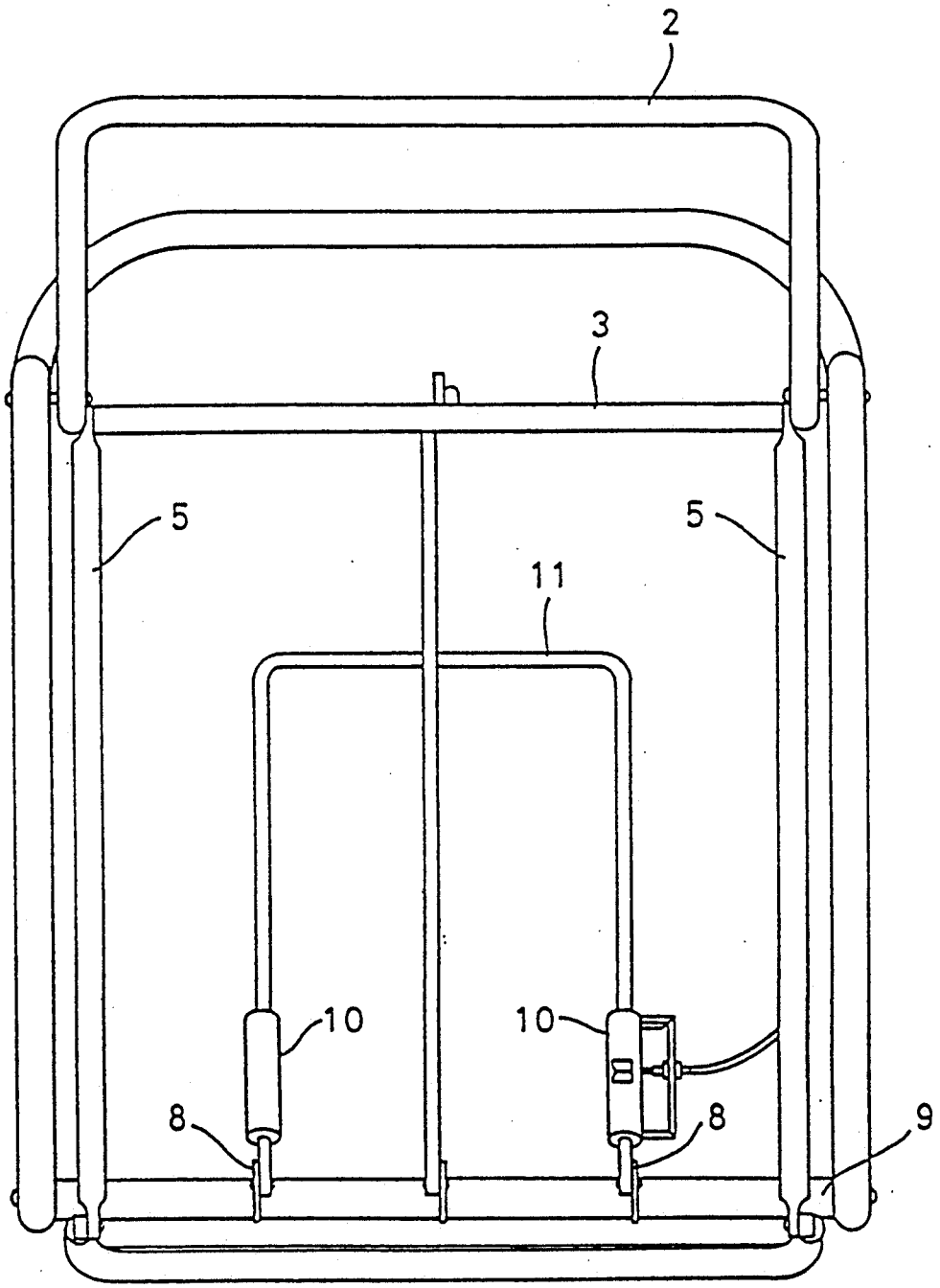

A preferred embodiment of the present invention will be described in more detail referring to FIGS. 1 to 4.

A reclining chair of the embodiment of the present invention has a base frame 1 of e.g. pipe material which is to be placed with its two foot portions 1*a*, 1*a* on a horizontal or planar surface such as a floor. The base frame 1 has a pair of upper or arm portions 1*b*, 1*b* which carry two rear-end pivots 4 and 4' respectively. A back rest 2 made of approximately U-shaped pipe material is pivotably mounted onto the rear-end pivots 4 and 4' with its two ends extended downward. A lower reinforcement member 3 is fixedly arranged between the lower ends of the back rest 2. The lower reinforcement

3 moves about the pivot axis as the back rest 2 pivots on the rear-end pivots 4 and 4'. There are also provided a couple of seat frames 5 and 5' which define a seat with the lower reinforcement member 3. The seat frame 5 and 5' are linked at rear end to the back rest 2 for pivotal movement about the joints between the back rest 2 and the lower reinforcement member 3.

The front ends of the seat frames 5 and 5' are pivotably coupled to the ends of two legs of a U-shaped foot rest 6. A foot rest support 7 is provided between the legs of the foot rest 6, which has a couple of pivot jibs 8 and 8' fixedly mounted to the back thereof. The jibs 8 and 8' are pivoted on the ends of two legs of a U-shaped support member 11 which carries a pair of tubular members 10 and 10' slidably fitted thereon. The tubular members 10 and 10' are fixedly mounted to a support plate 9 which extends between two leg portions of the base frame 1. Also, the foot rest support 7 has another pivot jib 12 fixedly mounted on the back center thereof. A connecting member or link 13 is pivotably mounted between the pivot jib 12 and a pivot jib 3*a* fixedly mounted to the lowermost of the lower reinforcement member 3.

The tubular member 10 is arranged variable in the inner diameter and its diameter adjustment can be controlled by a flexible wire (not shown) extending in a flexible sheath 15 to an operating lever 14 which is turnable. When the lever 14 is turned, the tubular member 10 becomes smaller in the inner diameter thus tightening the support member 11 and serving as a stopper for locking all the movable components including the back rest 2.

The back rest 2 and the seat frames 5 and 5' are furnished with canvas or the like (not shown) for providing a seat.

Figure 4:
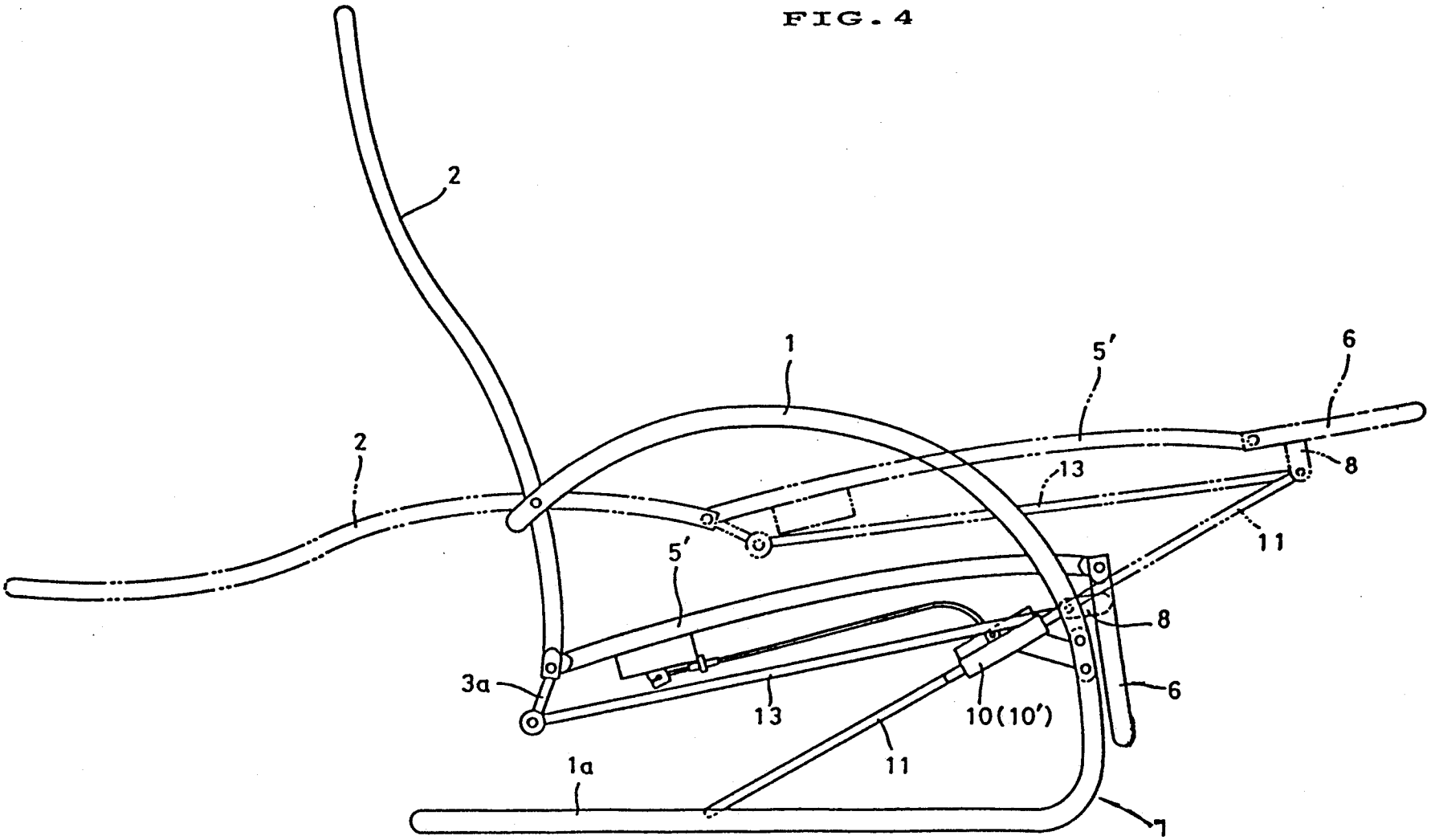

As apparent from FIG. 4, the foldable reclining chair of the present invention permits the back rest 2 to be tilted down to a location denoted by the two-dotted line. Simultaneously, the seat frames 5, 5', the foot rest support 6, the support member 11, and the connecting member 13 move to their respective locations denoted by the two-dotted lines of FIG. 4. Accordingly, a person who is sitting on the chair can be shifted from a sitting state to a reclining state. The tubular member 10 may be a rigid sleeve which is not variable in the inner diameter and provides no stopper action. In practice, its friction effect can successfully hold the back rest 2 in any tilting position.

As set forth above, the foldable reclining chair of the present invention has the back rest pivotably mounted to the base frame, which stands still on the floor, for tilting movement. Also, the seat is pivoted on a point lower than the pivot joints between the back rest and the base frame and supported by the base frame for forward and backward movement. The seat is coupled at front end to the foot rest which is linked with the back rest so that it can move from the vertical position to the horizontal position when the back rest is tilted down. In operation, when a user who is sitting on the chair tilts the back rest, the seat moves forward and thus, the user's center of gravity relative to the chair remains nearly unchanged thus maintaining the chair's stability. Also, the upward and downward movement of the seat is linked with the tilting action of the back rest which can thus be executed smoothly.

Furthermore, the foldable reclining chair of the present invention is formed of pipe materials thus exhibiting a favorable, casual look.

What is claimed is:

1. A chair comprising:

a base frame placeable on a floor; said base frame having left and right upper portions, said left and right upper portions each having distal and frontal ends, said base frame having a support plate positioned between the frontal ends of the left and right upper portions;

a back rest with top, middle, and bottom zones, said back rest being pivotably mounted at said middle zone to the distal ends of said left and right upper portions;

a seat having forward and rear sections, the seat being pivotably and supportedly mounted at its rear section to the bottom zone of the back rest;

a foot rest having far, near and back ends, the foot rest being pivotably mounted at said near end to and supporting the forward section of the seat so that it can move between a vertical position and a level position relative to the seat;

an extending member having anterior and posterior regions; the extending member being pivotably mounted at its anterior region to the back end of the foot rest;

tubular members slidably fitted on the extending member and fixedly mounted to the support plate; and a connecting member with a first and second end being pivotably mounted at the first end to the back end of the foot rest and at the second end to the bottom zone of the back rest at a point below the mounting of the rear section of the seat to the bottom zone of the back rest.

2. A chair according to claim 1, further comprising a means for selectively restricting the slide movement of the tubular members on the extending member.

* * * * *